US011311079B2

(12) United States Patent
Schaefer et al.

(10) Patent No.: US 11,311,079 B2
(45) Date of Patent: Apr. 26, 2022

(54) FOOTWEAR WITH FELTING TRANSITION BETWEEN MATERIALS

(71) Applicant: NIKE, Inc., Beaverton, OR (US)

(72) Inventors: Emily B. Schaefer, Beaverton, OR (US); Paul Lattin, Beaverton, OR (US); Craig K. Sills, Tigard, OR (US); Lai Wa C. Ho, Beaverton, OR (US); Rita Lin, Taichung (TW)

(73) Assignee: NIKE, Inc., Beaverton, OR (US)

( * ) Notice: Subject to any disclaimer, the term of this patent is extended or adjusted under 35 U.S.C. 154(b) by 407 days.

(21) Appl. No.: 15/409,329

(22) Filed: Jan. 18, 2017

(65) Prior Publication Data

US 2017/0202308 A1 Jul. 20, 2017

Related U.S. Application Data

(60) Provisional application No. 62/280,554, filed on Jan. 19, 2016.

(51) Int. Cl.
*A43B 23/02* (2006.01)
*A43B 1/00* (2006.01)

(52) U.S. Cl.
CPC ..... *A43B 23/021* (2013.01); *A43B 1/0027* (2013.01); *A43B 23/026* (2013.01); *A43B 23/0295* (2013.01)

(58) Field of Classification Search
CPC . A43B 23/0205; A43B 23/028; A43B 23/025; A43B 23/0295; A43B 1/02; A43B 23/0245; A43B 23/0255; D04H 18/00; D04H 13/005; B32B 9/04
USPC ..... 428/102, 608, 95, 57–61, 103; 112/405, 112/400, 401, 440, 441; 442/252, 234, 442/271; 12/146 C; 28/141, 107
See application file for complete search history.

(56) References Cited

U.S. PATENT DOCUMENTS 1,401,466 A 12/1921 De
1,725,749 A 8/1929 Blair
(Continued)

FOREIGN PATENT DOCUMENTS

CN 1067566 A 1/1993
CN 1342046 3/2002
(Continued)

OTHER PUBLICATIONS

"Abutt" Dictionary.com. Web. https://www.dictionary.com/browse/abut.*

(Continued)

*Primary Examiner* — Jillian K Pierorazio
(74) *Attorney, Agent, or Firm* — Schwegman Lundberg & Woessner, P.A.

(57) ABSTRACT

An article of footwear comprises a sole structure and an upper. The upper is connected to the sole structure to form an enclosure to at least partially receive a foot. The upper comprises a first panel, a second panel, a backing panel and fibers. The first panel and the second panel at least partially form the enclosure. The backing panel is located within the enclosure along surfaces of the first and second panels. The fibers extend from the backing panel and are mechanically embedded in the first and second panels so that at least some of the fibers are partially disposed outside the enclosure.

22 Claims, 9 Drawing Sheets

(56) References Cited

U.S. PATENT DOCUMENTS 2,158,533 A * 5/1939 Cavey ..... D04H 1/46 28/109
2,235,694 A 3/1941 Wolfhard et al.
2,293,370 A 8/1942 Tweedie
2,563,916 A 8/1951 Jacob
2,881,724 A 4/1959 Cremer et al.
2,896,303 A 7/1959 Morrill
3,364,098 A * 1/1968 Patsis ..... D06N 3/0013 442/381
3,441,464 A * 4/1969 Blue ..... B32B 5/024 428/85
3,497,414 A * 2/1970 Blue ..... D04H 1/498 428/85
3,535,187 A * 10/1970 Wood ..... D04H 5/08 425/82.1
3,562,931 A 2/1971 Karygiannis
3,605,223 A 9/1971 Barth
3,606,654 A 9/1971 Dilo
3,703,752 A 11/1972 Schulte
3,705,064 A * 12/1972 Lochner ..... D04H 1/48 156/72
3,772,746 A * 11/1973 Ivanowicz ..... D21F 7/083 28/110
3,774,273 A 11/1973 Okamoto et al.
3,794,553 A * 2/1974 Lochner ..... D04H 1/498 428/96
3,865,678 A * 2/1975 Okamoto ..... D03D 15/00 428/91
4,007,071 A * 2/1977 Addie ..... B32B 5/26 156/148
4,146,663 A * 3/1979 Ikeda ..... B32B 5/022 428/96
4,211,593 A * 7/1980 Lochner ..... B32B 5/06 156/148
4,353,158 A 10/1982 Henshaw
4,568,010 A 2/1986 Dilo
4,667,611 A 5/1987 Yamamoto et al.
4,683,624 A * 8/1987 Dufour ..... D21F 7/10 28/141
4,783,909 A 11/1988 Van Doren
4,794,874 A 1/1989 Slattery
4,798,760 A * 1/1989 Diaz-Kotti ..... D21F 7/083 442/35
4,891,870 A 1/1990 Muller
4,917,032 A 4/1990 Matsumoto
4,935,295 A * 6/1990 Serafini ..... D04H 3/10 442/383
5,003,674 A 4/1991 Cohen et al.
5,150,536 A * 9/1992 Strong ..... A43B 3/16 36/44
5,350,255 A * 9/1994 Carriker ..... B09B 1/00 405/129.6
5,507,900 A * 4/1996 Mohammed ..... B09B 1/00 156/157
5,537,939 A 7/1996 Horton
5,694,872 A 12/1997 Zeller
5,718,180 A 2/1998 Stutznaecker
5,802,739 A 9/1998 Potter et al.
5,909,883 A 6/1999 Jourde et al.
6,048,810 A * 4/2000 Baychar ..... A41D 27/02 36/117.3
6,170,414 B1 1/2001 Kaetterhenry et al.
6,237,174 B1 5/2001 Hutchinson
6,402,879 B1 6/2002 Tawney et al.
6,446,360 B1 * 9/2002 Sheets ..... A43B 23/022 36/55
6,743,519 B2 * 6/2004 Widdemer ..... A43B 1/02 28/103
7,246,418 B2 7/2007 Falk et al.
7,347,011 B2 3/2008 Dua et al.
7,966,956 B2 6/2011 Susuki et al.
8,429,835 B2 * 4/2013 Dojan ..... A43B 5/00 36/3 A
8,544,191 B2 10/2013 Marvin et al.
8,731,696 B2 5/2014 Jones et al.
8,739,716 B2 6/2014 Price et al.
8,764,931 B2 7/2014 Turner
9,044,063 B2 6/2015 Loverin et al.
9,185,947 B2 11/2015 Spencer et al.
9,273,423 B2 3/2016 Chen
10,151,056 B2 12/2018 Yamazaki
10,321,738 B2 6/2019 Lyke et al.
10,448,706 B2 10/2019 Ho
11,083,246 B2 8/2021 Lyke et al.
2002/0032955 A1 * 3/2002 Rasnick, Jr. ..... D02G 1/20 28/103
2002/0071946 A1 6/2002 Norton et al.
2002/0124324 A1 9/2002 Widdemer
2002/0172792 A1 * 11/2002 Jarvis ..... B29C 65/5021 428/57
2002/0172795 A1 * 11/2002 Gardner ..... B32B 5/06 428/85
2004/0109960 A1 * 6/2004 Rydin ..... D21F 1/0054 428/33
2004/0191470 A1 * 9/2004 Zafiroglu ..... B29C 70/24 428/96
2006/0218693 A1 10/2006 Sinohui, Jr.
2007/0271823 A1 11/2007 Meschter
2008/0010867 A1 1/2008 Davis, III
2008/0131648 A1 * 6/2008 Baychar ..... B32B 3/26 428/90
2009/0214822 A1 * 8/2009 Crook ..... B32B 5/26 428/137
2009/0246238 A1 * 10/2009 Gorman ..... A61L 15/26 424/402
2009/0280710 A1 * 11/2009 Zafiroglu ..... B32B 27/12 442/405
2010/0077634 A1 * 4/2010 Bell ..... A43B 23/04 36/54
2011/0174204 A1 7/2011 Berwanger et al.
2012/0144698 A1 * 6/2012 McDowell ..... B29C 51/002 36/45
2012/0244310 A1 * 9/2012 Visscher ..... B32B 5/08 428/95
2012/0255201 A1 10/2012 Little
2013/0004702 A1 * 1/2013 Schafer ..... B29C 44/351 428/102
2013/0255103 A1 * 10/2013 Dua ..... A43B 1/04 36/87
2013/0312284 A1 * 11/2013 Berend ..... A43B 1/0027 36/84
2014/0261121 A1 9/2014 Woodall et al.
2014/0283720 A1 9/2014 Kawaguchi et al.
2015/0007451 A1 1/2015 Bruce
2015/0101133 A1 4/2015 Manz et al.
2015/0157084 A1 6/2015 Bell et al.
2016/0069006 A1 3/2016 Dilo
2016/0135543 A1 5/2016 Anceresi et al.
2016/0194795 A1 * 7/2016 Pryne ..... D04H 1/46 28/108
2017/0202307 A1 7/2017 Lyke et al.
2017/0347745 A1 12/2017 Figur et al.
2019/0261740 A1 8/2019 Lyke et al.
2020/0008527 A1 1/2020 Ho
2021/0345731 A1 11/2021 Lyke et al.

FOREIGN PATENT DOCUMENTS

CN 1925763 A 3/2007
CN 101125044 A 2/2008
CN 101677649 A 3/2010
CN 102713042 10/2012
CN 202786694 3/2013
CN 203064780 7/2013
CN 104334043 A 2/2015
CN 104379099 2/2015
CN 105050442 11/2015
CN 105755679 7/2016
CN 110088374 A 8/2019
CN 110177478 A 8/2019

(56) References Cited

FOREIGN PATENT DOCUMENTS

| | | | |
|---|---|---|---|
| EP | 0717137 | | 6/1996 |
| EP | 1266584 | A1 | 12/2002 |
| EP | 2792261 | A1 | 10/2014 |
| EP | 2818070 | A1 | 12/2014 |
| FR | 463287 | A | 2/1914 |
| FR | 3007317 | A1 | 12/2014 |
| FR | 3031015 | | 7/2016 |
| JP | H11350327 | | 12/1999 |
| JP | H11350328 | A | 12/1999 |
| JP | 2003064571 | | 3/2003 |
| JP | 5945050 | B1 | 7/2016 |
| TW | 201629290 | A | 8/2016 |
| WO | 2013126475 | | 8/2013 |
| WO | WO-2014182651 | A1 | 11/2014 |
| WO | WO-2016151969 | A1 | 9/2016 |
| WO | 2017127441 | | 7/2017 |
| WO | 2017127449 | | 7/2017 |

OTHER PUBLICATIONS

"AMS-221 EN / IP-420 Instruction Manual. No. 02. 40135402", SanDisk Corporation, (Oct. 2016), 122 pgs.
"International Application Serial No. PCT/US2017/013964, International Search Report dated Apr. 5, 2017", 5 pgs.
"International Application Serial No. PCT/US2017/013964, Written Opinion dated Apr. 5, 2017", 8 pgs.
"International Application Serial No. PCT/US2017/013975, International Search Report dated Apr. 19, 2017", 4 pgs.
"International Application Serial No. PCT/US2017/013975, Written Opinion dated Apr. 19, 2017", 6 pgs.
"U.S. Appl. No. 15/409,311, Non Final Office Action dated Oct. 9, 2018", 13 pgs.
"U.S. Appl. No. 15/589,641, Examiner Interview Summary dated May 13, 2019", 4 pgs.
"U.S. Appl. No. 15/589,641, Notice of Allowance dated Jun. 12, 2019", 6 pgs.
"U.S. Appl. No. 15/589,641, Response filed May 28, 2019 to Non Final Office Action dated Feb. 25, 2019", 15 pgs.
"U.S. Appl. No. 16/408,909, Preliminary Amendment filed Jun. 11, 2019", 6 pgs.
"U.S. Appl. No. 15/409,311, Response filed Jan. 9, 2019 to Non Final Office Action dated Oct. 8, 2018", 11 pgs.
"U.S. Appl. No. 15/409,311, Notice of Allowance dated Feb. 6, 2019", 7 pgs.
"International Application Serial No. PCT/US2017/056851, International Search Report dated Feb. 7, 2018", 3 pgs.
"International Application Serial No. PCT/US2017/056851, Written Opinion dated Feb. 7, 2018", 10 pgs.
"U.S. Appl. No. 15/589,641, Non Final Office Action dated Feb. 25, 2019", 17 pgs.
"European Application Serial No. 17702251.4, Response filed Mar. 11, 2019 to Communication Pursuant to Rules 161 and 162 dated Aug. 31, 2018", 27 pgs.
"European Application Serial No. 17702253.0, Response filed Mar. 11, 2019 to Communication Pursuant to Rules 161 and 162 dated Aug. 30, 2018", 18 pgs.
"International Application Serial No. PCT/US2017/056851, International Preliminary Report on Patentability dated May 2, 2019", 12 pgs.
"International Application Serial No. PCT US2017 013964, International Preliminary Report on Patentability dated Feb. 8, 2018", 10 pgs.
"International Application Serial No. PCT US2017 013975, International Preliminary Report on Patentability dated Feb. 8, 2018", 8 pgs.
"U.S. Appl. No. 15/409,311, Response filed Sep. 17, 2018 to Restriction Requirement dated Jul. 23, 2018", 7 pgs.
"U.S. Appl. No. 15/589,641, Restriction Requirement dated Sep. 27, 2018", 7 pgs.
"U.S. Appl. No. 15/409,311, Restriction Requirement dated Jul. 23, 2018", 4 pgs.
"European Application Serial No. 17861919.3, Response to Communication Pursuant to Rules 161 162 filed Dec. 10, 2019", 11 pgs.
"Chinese Application Serial No. 201780012654.8, Office Action dated Apr. 24, 2020", w/o English translation, 9 pgs.
"European Application Serial No. 17861919.3, Partial supplementary European search report dated May 26, 2020", 13 pgs.
"U.S. Appl. No. 16/408,909, Restriction Requirement dated Jun. 23, 2020", 4 pgs.
"European Application Serial No. 17702251.4, Communication Pursuant to Article 94(3) EPC dated Jul. 23, 2020", 8 pgs.
"U.S. Appl. No. 16/408,909, Response filed Aug. 19, 2020 to Restriction Requirement dated Jun. 23, 2020", 8 pgs.
"European Application Serial No. 17861919.3, Extended European Search Report dated Aug. 27, 2020", 13 pgs.
"Chinese Application Serial No. 201780012654.8, Response filed Sep. 9, 2020 to Office Action dated Apr. 24, 2020", w current English claims, claims not amended in response filed, 11 pgs.
"U.S. Appl. No. 16/408,909, Non Final Office Action dated Oct. 13, 2020", 8 pgs.
"Chinese Application Serial No. 2017800143810, Office Action dated Sep. 29, 2020", w English Translation, 30 pgs.
"Chinese Application Serial No. 201780012654.8, Office Action dated Oct. 21, 2020", w English Translation, 8 pgs.
"Taiwanese Application Serial No. 106101969, Response filed Nov. 13, 2020 to Office Action dated May 11, 2020", w English claims, I am not sure if it's needed, but the agent included the full application in english and I didn't know which parts were amended so I kept it all in the PDF, 30 pgs.
"European Application Serial No. 17702251.4, Response filed Nov. 26, 2020 to Communication Pursuant to Article 94(3) EPC dated Jul. 23, 2020", 35 pgs.
"Chinese Application Serial No. 201780078475.4, Office Action dated Jan. 14, 2021", w English Translation of the search report, 8 pgs.
"U.S. Appl. No. 16/408,909, Corrected Notice of Allowability dated May 27, 2021", 3 pgs.
"U.S. Appl. No. 16/408,909, Notice of Allowance dated Apr. 5, 2021", 10 pgs.
"U.S. Appl. No. 16/408,909, Response filed Mar. 5, 2021 to Non Final Office Action dated Oct. 13, 2020", 11 pgs.
"Chinese Application Serial No. 201780012654.8, Office Action dated Mar. 17, 2021", w/ English translation, 7 pgs.
"Chinese Application Serial No. 201780012654.8, Response filed Mar. 4, 2021 to Office Action dated Oct. 21, 2020", w/ English claims, 21 pgs.
"Chinese Application Serial No. 201780012654.8, Response filed Jul. 19, 2021 to Office Action dated Mar. 17, 2021", w/ English claims, 37 pgs.
"Chinese Application Serial No. 2017800143810, Office Action dated Jul. 26, 2021", w/o English translation, 12 pgs.
"Chinese Application Serial No. 2017800143810, Response filed Apr. 14, 2021 to Office Action dated Sep. 29, 2020", w/ English claims, 23 pgs.
"Chinese Application Serial No. 201780078475.4, Office Action dated Jul. 9, 2021", w/o English translation, 5 pgs.
"Chinese Application Serial No. 201780078475.4, Response filed Apr. 27, 2021 to Office Action dated Jan. 14, 2021", w/ English claims, 19 pgs.
"European Application Serial No. 17702251.4, Communication Pursuant to Article 94(3) EPC dated Feb. 22, 2021", 8 pgs.
"European Application Serial No. 17861919.3, Response filed Feb. 23, 2021 to Extended European Search Report dated Aug. 27, 2020", 15 pgs.
"Taiwanese Application Serial No. 106101971, First Office Action dated Aug. 12, 2021", w/ English translation, 7 pgs.
U.S. Appl. No. 16/408,909, U.S. Pat. No. 11,083,246, filed May 10, 2019, Footwear With Embroidery Transition Between Materials.
U.S. Appl. No. 17/381,417, filed Jul. 21, 2021, Footwear With Embroidery Transition Between Materials.
U.S. Appl. No. 16/574,468, filed Sep. 18, 2019, Systems and Methods for Manufacturing Footwear With Felting.

(56) References Cited

OTHER PUBLICATIONS

"U.S. Appl. No. 16/574,468, Preliminary Amendment filed Oct. 28, 2021", 6 pgs.
"European Application Serial No. 17702251.4, Response filed Sep. 2, 2021 to Communication Pursuant to Article 94(3) EPC dated Feb. 22, 2021", 22 pages.
"Chinese Application Serial No. 201780078475.4, Response filed Sep. 7, 2021 to Office Action dated Jul. 9, 2021", With English claims, 18 pages.
"Chinese Application Serial No. 201780078475.4, Office Action dated Sep. 22, 2021", w English Translation, 13 pgs.
"Chinese Application Serial No. 201780078475.4, Office Action dated Jan. 25, 2022", W English Translation, 14 pgs.
"Taiwanese Application Serial No. 106101971, Response filed Feb. 15, 2022 to First Office Action dated Aug. 12, 2021", w English claims, 31 pgs.
"Chinese Application Serial No. 201780078475.4, Response filed Nov. 19, 2021 to Office Action dated Sep. 22, 2021", w English claims, 51 pgs.
"Chinese Application Serial No. 2017800143810, Response filed Dec. 9, 2021 to Office Action dated Jul. 26, 2021", w English claims, 30 pgs.

* cited by examiner

FOOTWEAR WITH FELTING TRANSITION BETWEEN MATERIALS

CLAIM OF PRIORITY

This application claims the benefit of priority of U.S. Provisional Patent Application Ser. No. 62/280,554, filed on Jan. 19, 2016, which is incorporated by reference herein in its entirety.

CROSS-REFERENCE TO RELATED PATENT DOCUMENTS

This patent application is also related to Application No. 62/280,547, filed on Jan. 19, 2016 entitled "Footwear with Embroidery Transition Between Materials."

BACKGROUND

The present disclosure relates to seams or joints for connecting pieces of material that can be used in clothing, footwear and the like. In an exemplary application, the present disclosure relates to the construction of uppers for shoes. Shoe uppers are typically fabricated from a plurality of different materials in order to provide different performance characteristics at different locations on the shoe. For example, it might be desirable for the shoe to be breathable near the toes to allow escape of perspiration, but more rigid at the heel to keep the shoe attached to the foot during use. Thus, a shoe might incorporate a fabric mesh panel near the toe cap and a reinforced polymer panel near the heel cap. Other materials used in footwear may be relatively flexible and tough such as those used near the metatarsophalangeal (MTP) joint between the metatarsal bones of the foot and the proximal phalanges of the toes where repeated bending occurs. Thus, a shoe might incorporate a panel made of leather, vinyl or the like at the vamp.

In order to accommodate the different sizes, shapes and materials used in the panels of shoe uppers, a variety of seaming and joining methods are typically used. Lap joints and butt joints have conventionally been used, as is described in U.S. Pat. No. 2,235,694 to Wolfhard et al. More recently, footwear has incorporated smooth seams, such as those using thermoplastic seam tape as is described in U.S. Pat. No. 8,544,191 to Marvin et al., or seamless joints, such as those using a knitting process including forming an upper by interconnecting a series of stitches or loops as is described in U.S. Pub. No. 2012/0255201 to Little. Additionally, other uppers have been made from a unitary textile material having different stitching or weaving portions to induce different performance characteristics or different aesthetic qualities at different portions of the upper, as is described in U.S. Pat. No. 7,347,011 to Dua et al.

U.S. Pat. No. 5,003,674 to Cohen et al. describes needle felted fabrics. U.S. Pat. No. 6,743,519 to Widdemer describes supplementary fiber structures for leather.

OVERVIEW

The present inventors have recognized, among other things, that a problem to be solved can include panels in footwear uppers that are joined at seams that are uncomfortable on the inside of the footwear and unaesthetically pleasing on the outside of the footwear. The present subject matter can help provide a solution to this problem, such as by joining panels using a felting stitch or felting pattern that can be flatter than a conventional lap joint, thereby providing a more comfortable seam. The present subject matter can help provide a solution to this problem, such as by joining panels using a felting stitch or felting pattern that is flatter and less abrupt than conventional joints. For example, felting patterns can be more comfortable owing, for instance, to a flatter seam than a traditional lap joint. As another example, felting patterns can be more aesthetic owing, for instance, to a less abrupt seam than a traditional butt joint. In particular, the felting patterns described herein can provide a joint that appears to seamlessly blend upper panels of different materials, colors and textures into each other.

In an example, an article of footwear comprises a sole structure and an upper. The upper is connected to the sole structure to form an enclosure to at least partially receive a foot. The upper comprises a first panel, a second panel, a backing panel and fibers. The first panel and the second panel at least partially form the enclosure. The backing panel is located within the enclosure along major surfaces of the first and second panels. The fibers extend from the backing panel and are mechanically embedded in the first and second panels so that at least some of the fibers are partially disposed outside the enclosure.

In an example, fibers of the backing panel, or some other fibers, extend through the first panel and second panel. In another example, a volume of the fibers of the backing panel disproportionately extend through the first panel relative to the second panel in order to provide a transition between the first and second panels having a gradient of color, texture or material, as well as a gradient of frictional forces providing the mechanical interface.

This overview is intended to provide an overview of subject matter of the present patent application. It is not intended to provide an exclusive or exhaustive explanation of the invention. The detailed description is included to provide further information about the present patent application.

Figure 1A:
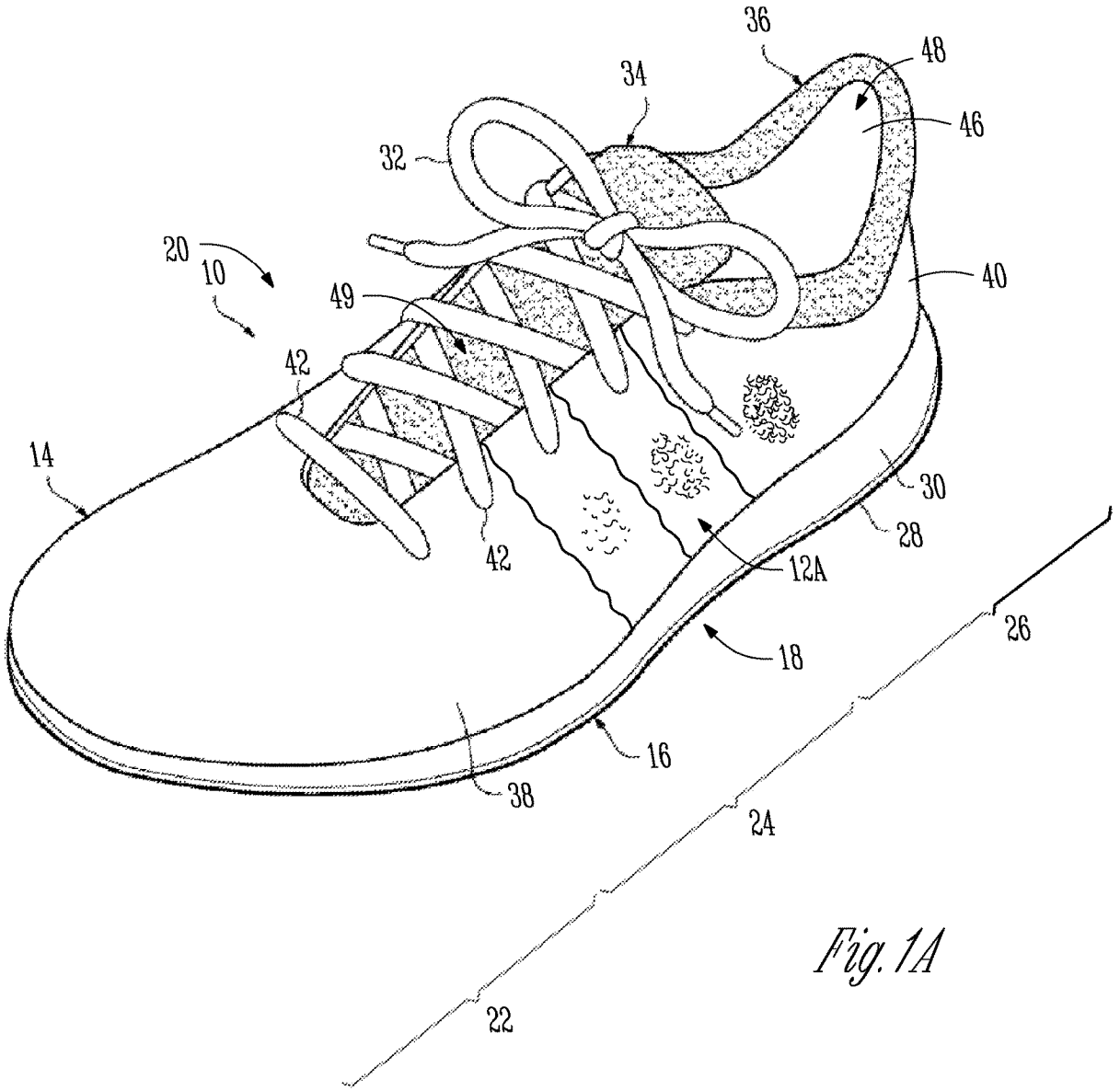
FIG. 1A is a perspective view of a lateral side of an article of footwear having an upper with two panels joined by a felting stitch of the present disclosure.

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1B:
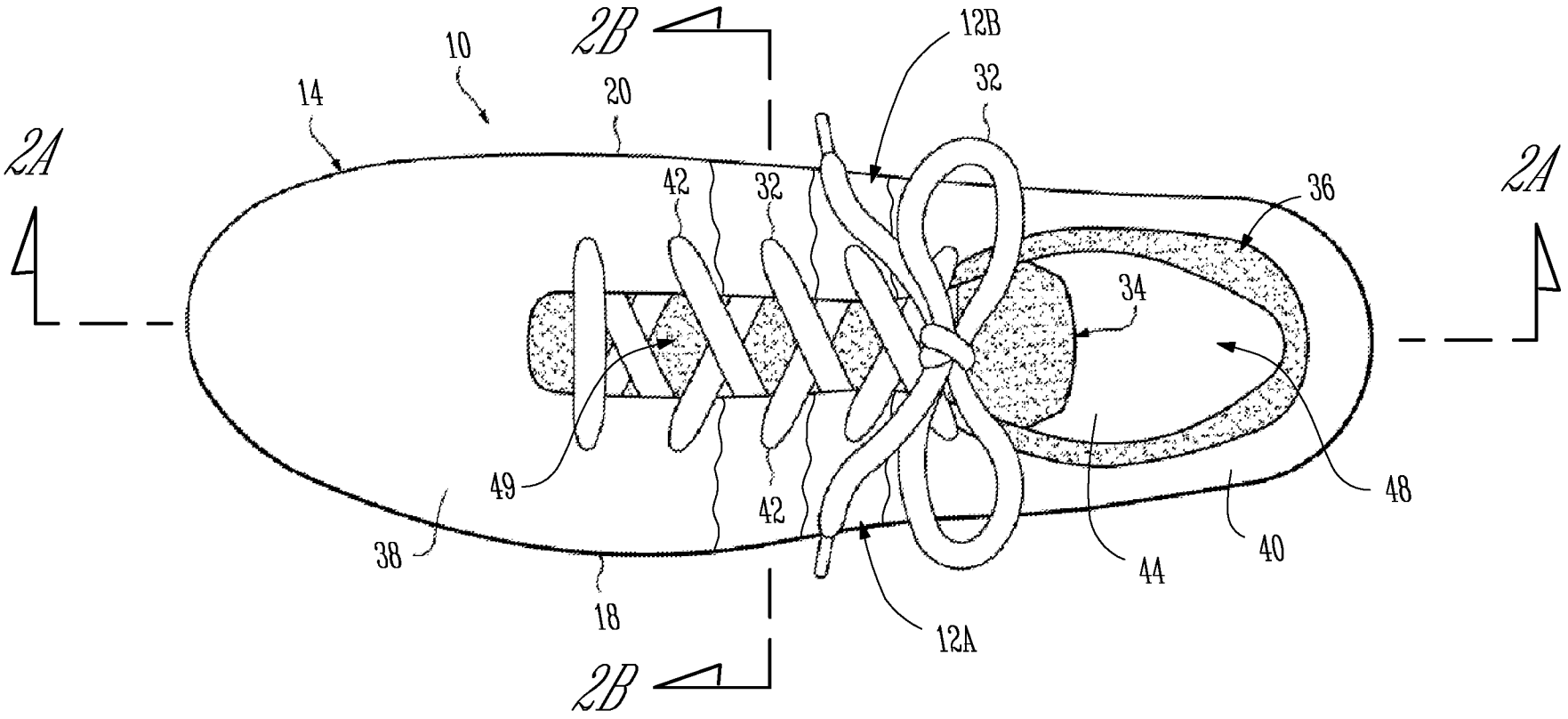
FIG. 1B is a top view of the article of footwear of FIG. 1A showing medial and lateral sides of the upper each having a felting transition pattern produced by a felting stitch.
Figure 1C:
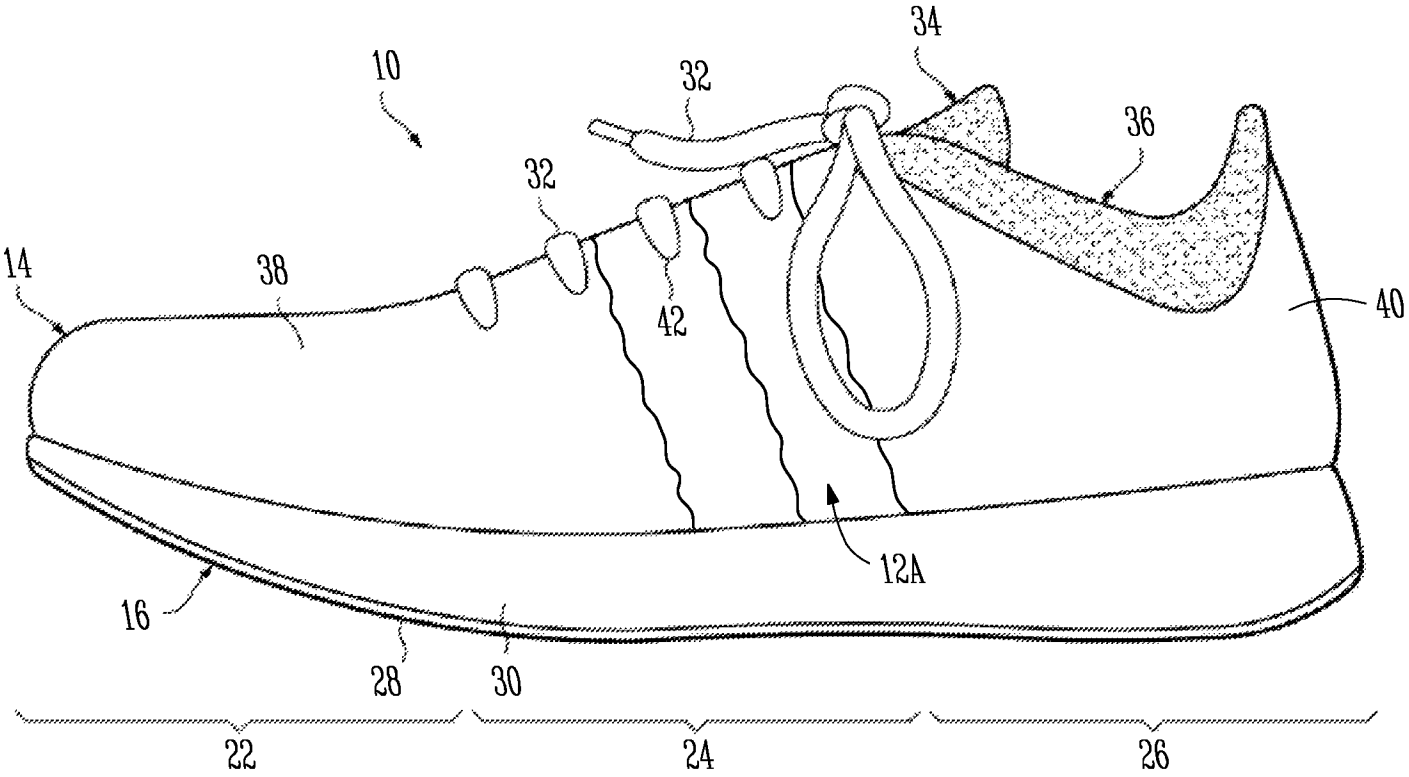
FIG. 1C is a lateral side view of the article of footwear of FIG. 1A illustrating different regions of the article of footwear.

FIG. 1A is a perspective view of article of footwear 10 having felting 12A on upper 14, which is connected to sole structure 16. FIG. 1B is a top view of article of footwear 10, showing lateral side 18 and medial side 20 having felting 12A and 12B, respectively. FIG. 1C shows lateral side 18 of article of footwear 10 illustrating forefoot region 22, midfoot region 24, and heel region 26. Sole structure 16 can include outsole 28 and midsole 30. Upper 14 can include lace 32, tongue 34 and collar element 36. Upper 14 can be comprised of a plurality of panels of different or the same material, such as toe panel 38 and heel panel 40. Various panels of upper 14 can be connected to each other via felting 12A.

In the example shown, upper 14 includes toe panel 38 and heel panel 40 that at least partially surround a foot. Each of toe panel 38 and heel panel 40 can wrap, at least partially, around medial and lateral sides of upper 14. For example, toe panel 38 can form a vamp for footwear 10, extending from the lateral MTP joint area of the foot, around the toe cap of footwear 10, and to the medial MTP joint area of the foot. Likewise, heel panel 40 can form a heel counter for footwear 10, extending from the lateral midfoot area of the foot, around the heel cap of footwear 10, and to the medial midfoot area of the foot. Collectively, panels 38 and 40, along with other parts of footwear 10, form a housing when joined to sole structure 16 for at least partially enclosing the foot. Upper 14 can include apertures 42, insole 44, lining 46 and foot space 48. Components of upper 14, including tongue 34, collar element 36, toe panel 38 and heel panel 40, may be formed of various materials, such as knitted, woven, natural or synthetic materials. Toe panel 38 and heel panel 40 can be comprised of one or more sub-panels. Each panel 38 and 40 and sub-panel of footwear 10 can be joined together using conventional stitching and seaming structures and methods. Additionally, as described herein, various panels and sub-panels can be joined using a felting stitch that results in a felting pattern or "felting" that can indirectly link the panels 38 and 40 together such as via a backing panel.

Figure 8:
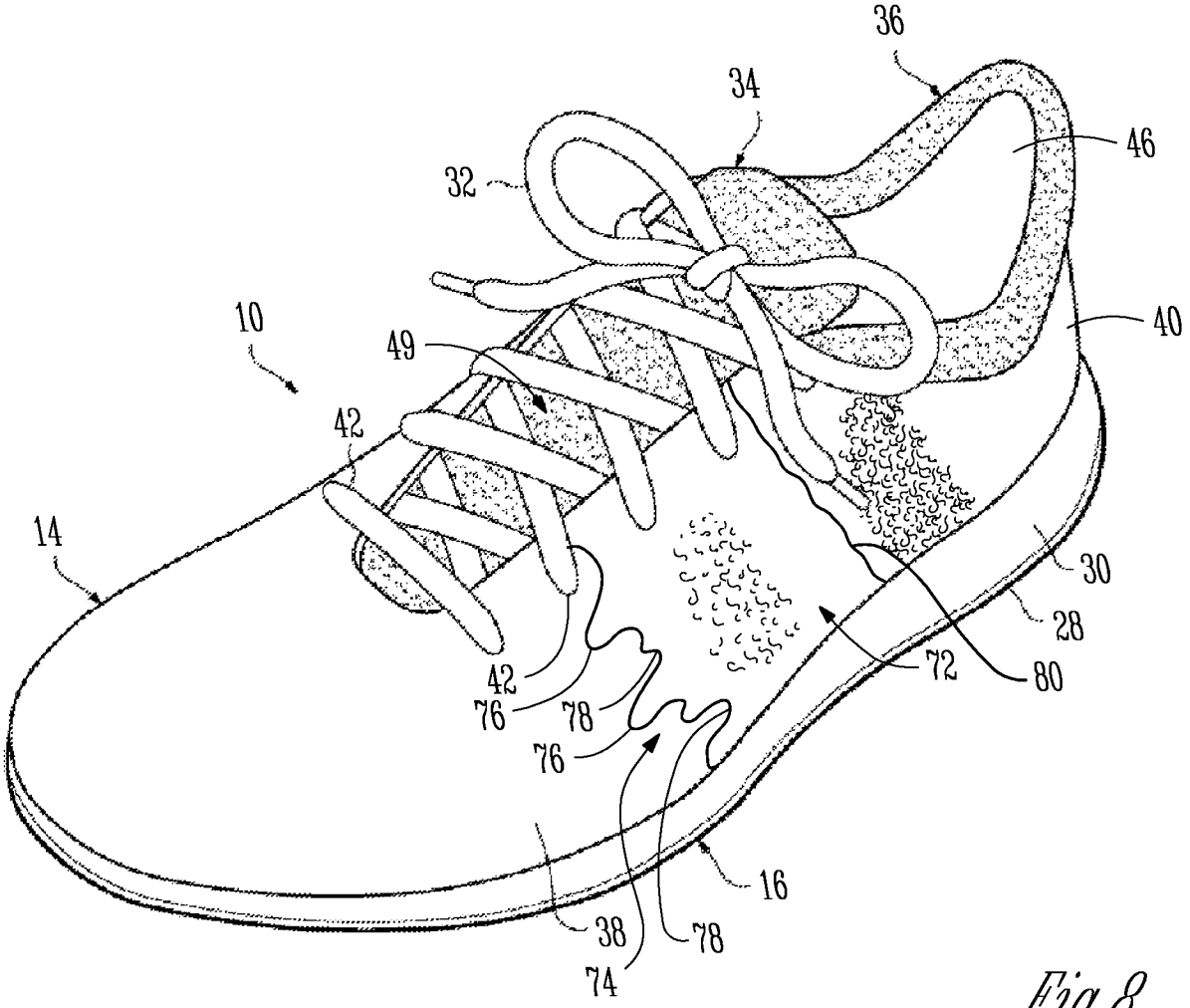
FIG. 8 is a perspective view of an article of footwear having a first panel and a second panel of an upper joined by a felting stitch simulating a bleed pattern.

In the example, shown, felting 12A extends across anterior-posterior ends or edges of toe panel 38 and heel panel 40 and forms a junction therebetween to mechanically interlock panels 38 and 40, thereby reducing or eliminating the need for separate stitching that directly links panel 38 and panel 40. Additionally, felting 12A can have different densities on the materials of panels 38 and 40 to provide varying levels of frictional interlock, as discussed in greater detail below. Felting 12A can have a gradient to provide a transition between the colors, textures and materials, and combinations thereof, of panels 38 and 40. Furthermore, felting 12A can be shaped to provide aesthetic aspects to footwear 10, such as shown in FIG. 8.

Forefoot region 22 generally includes portions of footwear 10 corresponding with the toes and the joints connecting the metatarsals with the phalanges (the MTP joints). Midfoot region 24 generally includes portions of footwear 10 corresponding with the arch area of the foot. Heel region 26 generally corresponds with the heel area of the foot, including the calcaneus bone. Lateral side 18 and medial side 20 extend through each of regions 22-26 in an anterior-posterior direction. Regions 22-26 and sides 18 and 20 are not intended to demarcate precise areas of footwear 10. Rather, regions 22-26 and sides 18 and 20 are intended to represent general areas of footwear 10 to aid in the discussion of footwear 10.

Felting of the present disclosure, such as felting 12A and 12B, can be located in various places and in various orientations in each of the regions and sides of footwear 10. It can, however, be desirable to position felting away from high stress points of footwear 10. For example, it can be desirable to position felting away from the MTP joint to avoid stressing the felting fibers due to the repeated bending of the foot. In the example described herein, felting 12A is located along the tarsals, posterior of the MTP joint, and felting 12B is located along the instep of the foot, posterior of the MTP joint. Felting can additionally or alternatively be located on the distal superior surface of toe panel 38, on the posterior surface of heel panel 40, on tongue 34 and other locations throughout footwear 10.

Tongue 34 can be connected to toe panel 38 and can extend under lace 32 to enhance the comfort and adjustability of footwear 10. Tongue 34 can extend between opposing portions of toe panel 38 and opposing portions of heel panel 40. Opposing portions of heel panel 40 can be fitted with collar element 36. Collar element 36 is located in at least heel region 26. Collar element 36 and tongue 34 form an opening for providing an access point for a foot into the interior of upper 14. Lace 32 extends through various lace apertures 42 and across throat area 49 of upper 14 to permit a wearer of footwear 10 to modify dimensions of upper 14 and accommodate the proportions of the foot. Lace 32 can operate in a generally conventional manner to tighten upper 14 around the foot when lace 32 is cinched, thereby shrinking the size of foot space 48 of the housing formed by panels 38 and 40. When lace 32 is loosened, upper 14 is also loosened to enlarge the size of foot space 48 of the housing. Footwear 10 can alternatively be provided with other types of fastening systems, such as elastic, hook and loop fastener and similar systems.

A foot of a wearer of footwear 10 can rest on sole structure 16, while upper 14 surrounds the foot to maintain the foot inserted into footwear 10. Sole structure 16 is secured to upper 14 and extends between the foot and the ground when footwear 10 is worn. Midsole 30 is secured to lower portions of upper 14 and can be secured to upper 14 by adhesive, stitching or other suitable means.

Suitable materials for midsole 30 include polymer foam materials such as ethylvinylacetate or polyurethane, or any other material that compresses resiliently so as to attenuate ground reaction forces (i.e., provide cushioning) when compressed between the foot and the ground during walking, running, or other ambulatory or athletic activities associated with a human gait or movement of the foot.

Insole 44 (FIG. 1B) can typically comprises a removable insert disposed atop midsole 30, and can provide additional cushioning or ventilation (e.g. by including perforations).

Insole 44 can be located within upper 14 and is positioned to extend under a lower surface of the foot.

Outsole 28 is secured to a lower surface of midsole 30 and may be formed from a wear-resistant rubber material that is textured to impart traction. Outsole 28 can be attached to the lower surface of midsole 30 by adhesive or other suitable means. Suitable materials for outsole 28 include polymers, e.g., polyether-block co-polyamide polymers (sold as Pebax® by ATOFINA Chemicals of Philadelphia, Pa.), and nylon resins such as Zytel®, sold by Dupont. Other suitable materials for outsole 28 and midsole 30 can also be used as are known in the art. Outsole 28 can include various features for providing traction, such as lugs and ribs.

Midsole 30 may incorporate fluid-filled chambers, plates, moderators, or other elements that further attenuate forces, enhance stability, or influence motions of the foot, or midsole 30 may be primarily formed from a fluid-filled chamber. An air bladder can comprise two plies of polymeric membrane, as is described in U.S. Pat. No. 5,802,739 to Potter et al. In another example, a four-ply air bladder can be used, as is described in U.S. Pat. No. 6,402,879 to Tawney et al. In yet another example, a fabric cushioning element can be used, as is described in U.S. Pat. No. 8,764,931 to Turner. The entire contents of U.S. Pat. Nos. 5,802,739; 6,402,879; and 8,764,931 are hereby incorporated in their entirety by this reference for all purposes. In yet other examples, a bladder may be filled with other gases, such as nitrogen, helium or so-called dense gases such as sulfur hexafluoride, a liquid, or gel.

Upper 14 and sole structure 16 can be configured to enhance the appearance, comfort and performance of footwear during a variety of activities. Although the present description is written with reference to a general purpose athletic shoe, the disclosure of the present application can be applied equally to other types of footwear, such as, but not limited to, dress shoes, running shoes, leisure shoes, fashion shoes, golf shoes, football cleats, soccer shoes, baseball cleats, tennis shoes, sandals, boots, slippers and the like. Additionally, the disclosure of the present application may be used in other articles of manufacture including textiles, articles of apparel and articles of clothing.

Figure 2A:
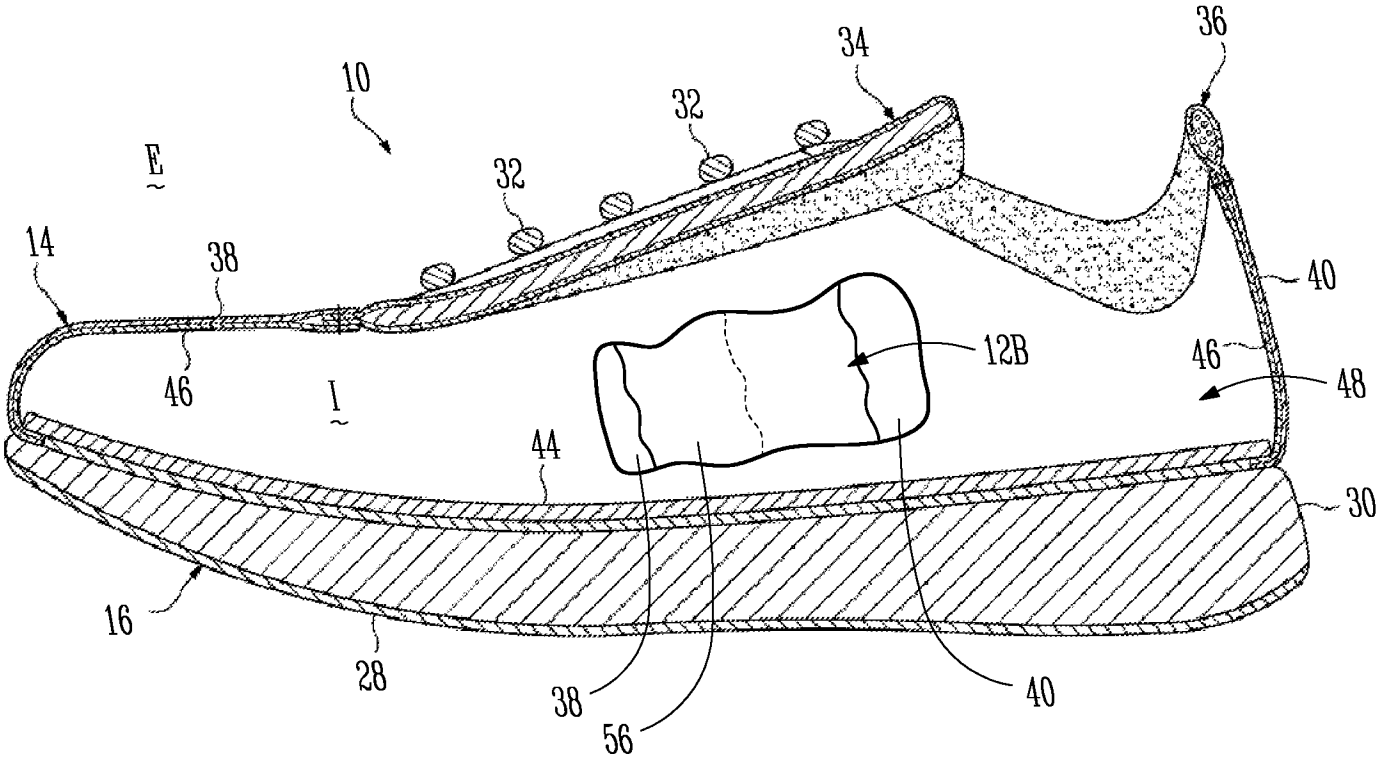
FIG. 2A is a cross-sectional view of the article of footwear of FIG. 1B taken along a toe-to-heel cut to show an internal foot space.
Figure 2B:
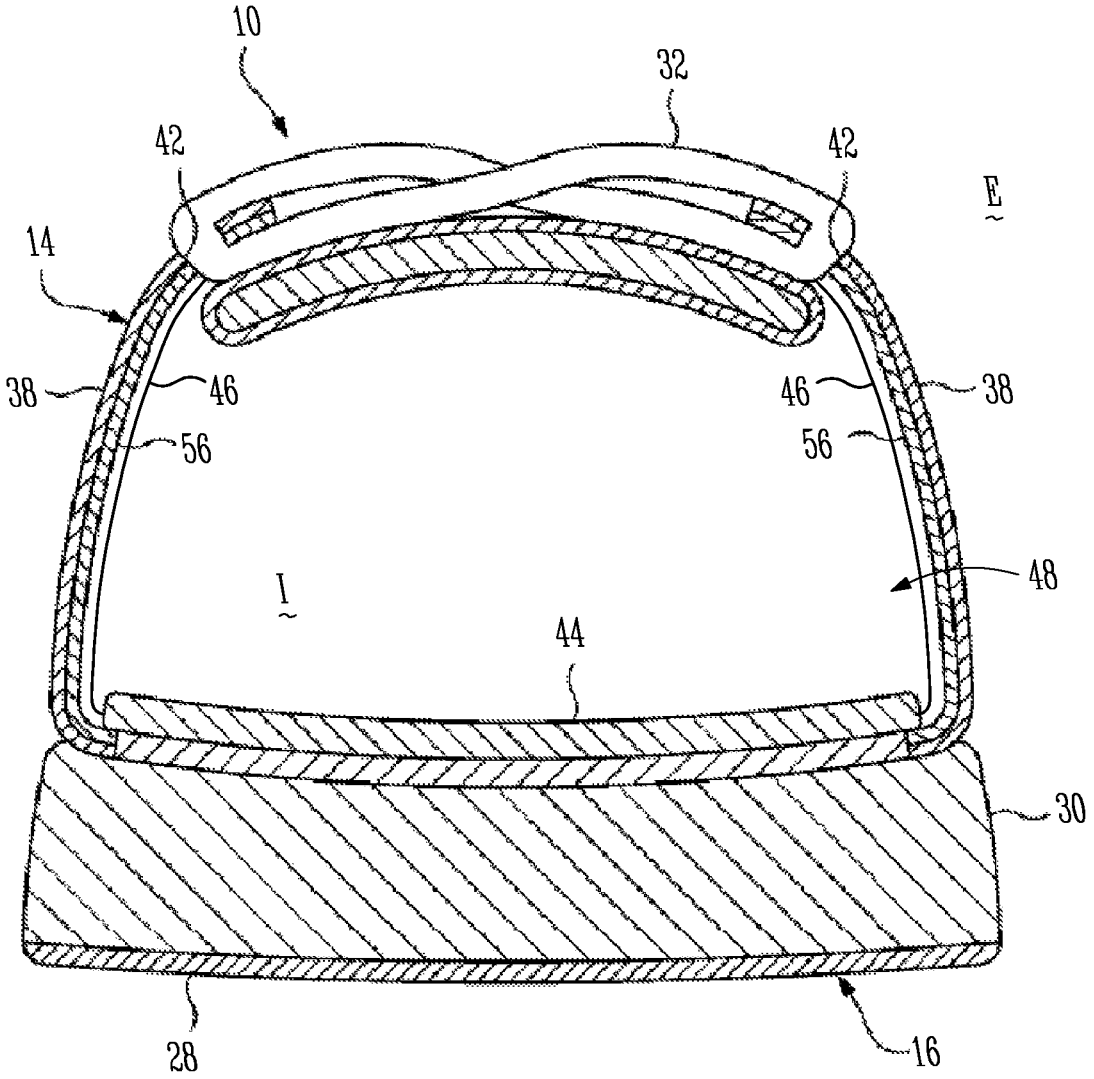
FIG. 2B is a cross-sectional view of the article of footwear of FIG. 1B taken along a medial-lateral cut to show an insole and a lining layer.

FIG. 2A is a cross-sectional view of article of footwear 10 of FIG. 1B taken along a toe-to-heel cut to show internal foot space 48. FIG. 2B is a cross-sectional view of article of footwear 10 of FIG. 1B taken along a medial-lateral cut to show insole 44 and lining layer 46. A portion of lining layer 46 is broken away in FIG. 2A to show felting 12B on an interior side of toe panel 38 and heel panel 40.

Upper 14 is formed from various layers including those formed by toe panel 38 and heel panel 40 that combine to provide a structure for securely and comfortably receiving a foot. Although the configuration of upper 14 may vary significantly, the various elements generally define a void within footwear 10 for receiving and securing the foot relative to sole structure 16 within foot space 48. Additionally, upper 14 can include internal layers, such as lining layer 46. Lining 46 can provide a smooth, aesthetically appealing, comfortable surface within foot space 48 for the foot and can line the entirety or most of upper 14 in foot space 48. Panels 38 and 40 form at least a portion of an exterior surface of upper 14. Lining layer 46 forms at least a portion of an interior surface of upper 14, i.e., the surface defining foot space 48.

Panels 38 and 40 and lining layer 46 may be formed from a variety of materials (e.g., textiles, fabrics, polymer foam, leather, synthetics) that can be stitched, bonded or felted together. As an example, panel 38 can be formed of a smooth material, such as leather or a synthetic material, while panel 40 can be formed of a breathable material, such as a mesh, woven or knitted material. In many conventional shoes, panels of starkly contrasting materials adjoin at edges that form distinct lines. Those lines can be covered with various foxing, striping, piping or webbing, but those items themselves can leave sharply visible edge lines and add potentially undesirable thickness and stiffness to the shoe.

Felting 12A can be configured to provide a comfortable, aesthetically pleasing joint between toe panel 38 and heel panel 40. Felting 12A can include backing panel 56, which can be located in the interior I of upper 14 in foot space 48. Backing panel 56 provides a material having fibers that can be extended into toe panel 38 and heel panel 40. For example, fibers of backing panel 56 can be pushed or pulled through toe panel 38 and heel panel 40 using barbed needles to the exterior E of footwear 14. The displaced fibers of backing panel 56 remain connected to backing panel 56 to interlock each of toe panel 38 and heel panel 40 with backing panel 56. The portions of the fibers extended out to the exterior E can affect the feel and look of upper 14.

Figure 3:
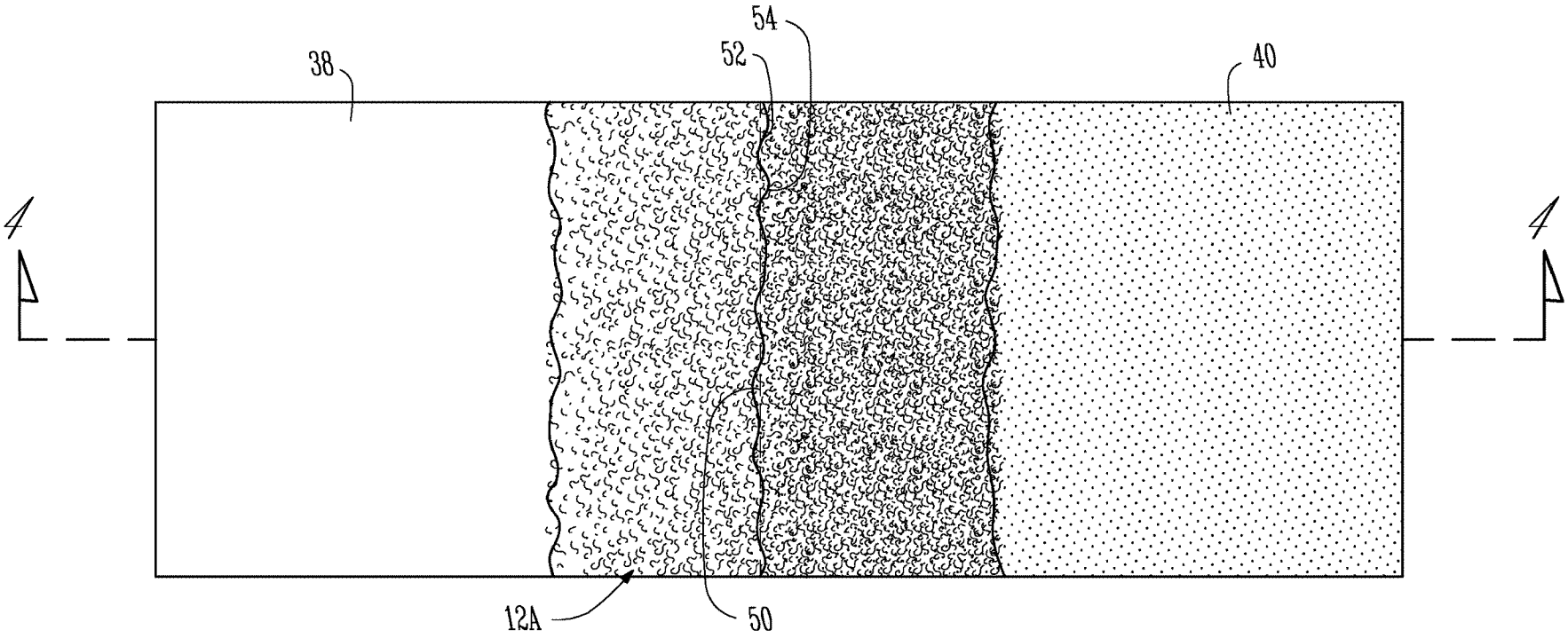
FIG. 3 is a schematic view of a first panel and a second panel of an upper for an article of footwear joined by a felting stitch.

FIG. 3 is a schematic view of toe panel 38 and heel panel 40 of upper 14 for article of footwear 10 joined by felting 12A. Felting 12A comprises fibers of a backing panel, e.g. backing panel 56 of FIG. 4, that are pushed or pulled, so as to extend, through toe panel 38 and heel panel 40 to interlock the panels of upper 14 with backing panel 56, thereby linking panels 38 and 40 of upper 14 to each other.

Figure 4:
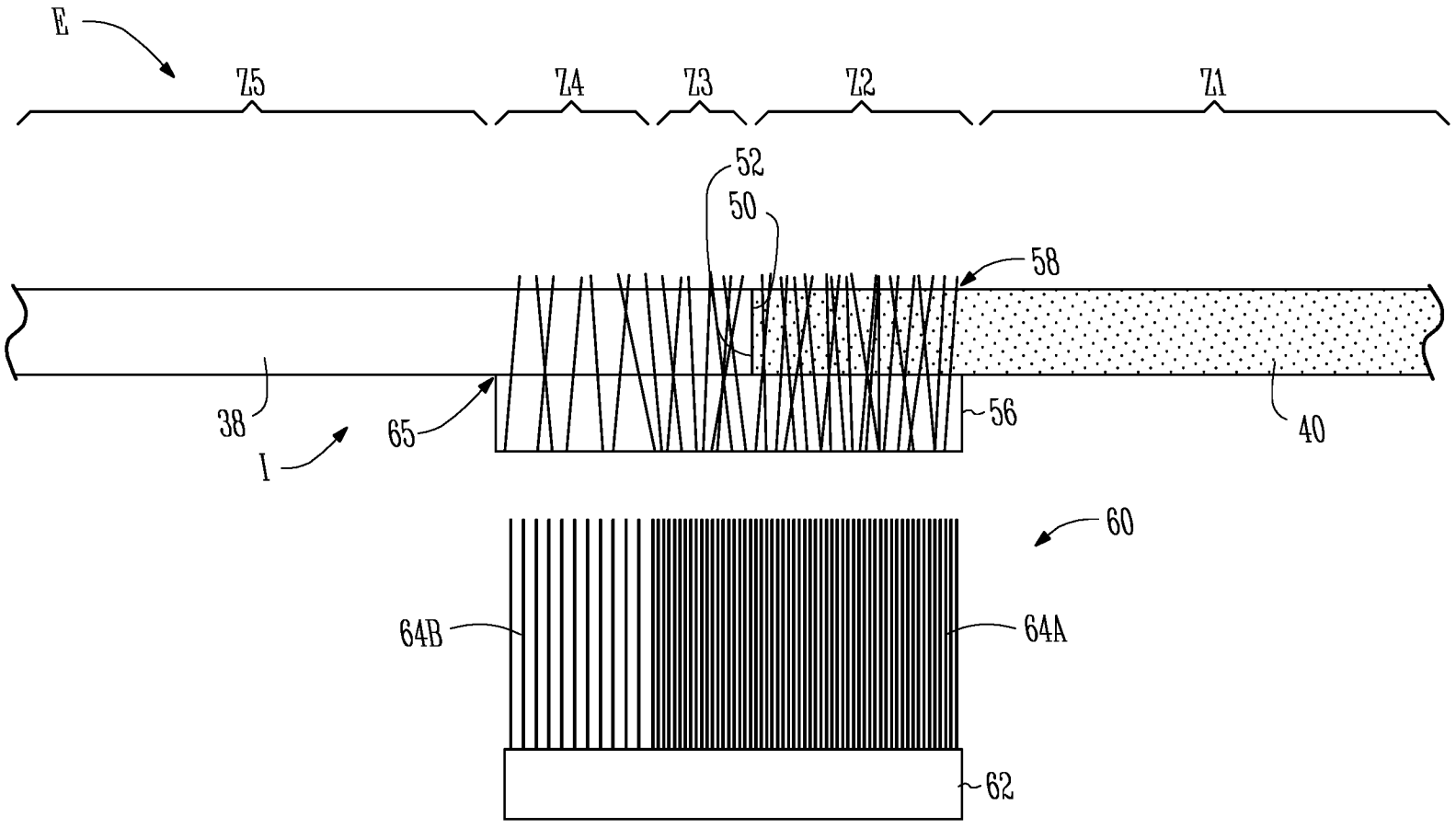
FIG. 4 is a cross-sectional view of the felting stitch of FIG. 3 showing an embodiment where a backing panel is positioned on an interior of the first panel and the second panel along the felting stitch.

In the example of FIG. 3, toe panel 38 and heel panel 40 are positioned in an abutting relationship such that posterior edge 50 of toe panel 38 abuts anterior edge 52 of heel panel 40, as can additionally be seen in FIG. 4. Posterior edge 50 and anterior edge 52 can be joined by stitch 54. Stitch 54 comprises an initial connection between toe panel 38 and heel panel 40 that provides immobilization between the two panels in order to allow the felting process to take place. In other examples, stitch 54 is omitted. Stitch 54 may comprise a single fiber or strand having a zigzag shape. In yet other examples, a stitch having a different shape or different number of strands can be used. For example, a smoothly curved stitch or a two- or three-strand stitch may be used. However, the fastening provided by stitch 54, or its alternatives, need not provide the main securing force between panels 38 and 40 as that can be provided by felting 12A.

Felting 12A simultaneously provides mechanical coupling between panels 38 and 40 and a customizable, aesthetically variable arrangement or pattern on upper 14. In the example of FIG. 3, felting 12A forms a gradient between panels 38 and 40 that provides a linear change in the density of felting 12A from panel 38 to panel 40. Thus, felting 12A can provide a transition between panel 38 and panel 40 that softens the hard edge formed at the juncture of posterior edge 50 and anterior edge 52. Felting 12A can also be used to provide an aesthetically pleasing transition between toe panel 38 and heel panel 40, such as the bleed pattern shown in FIG. 8. In the example of FIGS. 3 and 4, the density of felting 12A trails off, or becomes reduced in density as it extends from heel panel 40 into toe panel 38. As such, backing panel 56 can match the color or material of heel panel 40 and felting 12A can appear to simulate a fading of heel panel 40 into toe panel 38.

FIG. 4 is a cross-sectional view of felting 12A of FIG. 3 showing an embodiment where backing panel 56 is positioned along an interior I of toe panel 38 and heel panel 40. Backing panel 56 includes fibers 58 that extend through to an exterior E of toe panel 38 and heel panel 40. FIG. 4 also shows felting tool 60 disposed adjacent felting 12A. Felting tool 60 includes base 62 and needles 64, which includes first needle zone 64A and second needle zone 64B. First needle zone 64A can have a higher density of needles than second needle zone 64B. The dimensions, e.g. thicknesses, of panels 38 and 40 and backing panel 56 are, unless otherwise specified, not drawn to scale and are exaggerated for illustrative purposes. Together, toe panel 38, heel panel 40 and backing panel 56 combine to provide upper 14 with a plurality of zones on exterior E of footwear 10. In the example of FIG. 4, zones Z1 through Z5 are shown, each zone having a different material and felting density combination.

In the example shown, backing panel 56 is positioned directly against major surfaces of toe panel 38 and heel panel 40 within the interior I. Fibers 58 of backing panel extend through toe panel 38 and heel panel 40. Tips and loop-ends of fibers 58 extend beyond an exterior E of toe panel 38 and heel panel 40 in order to provide a visual and tangible finish to major surfaces of panels 38 and 40 from the exterior E. As such, backing panel 58 can be fabricated from a material that is made of a plurality of fibers or strands, or a jumbled mesh of a single strand or fiber. In examples, backing panel 58 can comprise a panel fabricated from a plurality of densely packed fibers, such as felt or wool. In an example, a width of backing panel 56 is approximately the same width as embroidery 12A. However, in other examples, the width of backing panel 56 can be wider than embroidery 12A. In yet another example, backing panel 56 can extend across an entirety of, or a substantial portion of, the interior surfaces of upper 14. In such an example, backing panel 56 can act as or replace lining 46.

The degree or amount of felting, e.g. the quantity of fibers 58 from backing panel 56 extending through the material of upper 14, can depend on the density of needles 64 in felting tool 60. For example, felting tool 60 is shown having needle zone 64A having a higher density of needles than needle zone 64B. The orientation of felting tool 60, i.e., whether needle zone 64B is positioned to interact with toe panel 38 or heel panel 40, can be selected based on a variety of factors, such as the color of backing panel 56. For example, the higher density of needles in needle zone 64A can be positioned to coincide with the panel having a color that matches the color of backing panel 56. Backing panel 56 can have a color selected to match either of toe panel 38 or heel panel 40. However, the higher density of needles can also be selected based on mechanical felting properties. For example, it can be better to have a higher density of fibers 58 interact with a less fibrous material, such as leather, to provide a higher frictional engagement, whereas a relatively lower amount of fibers may provide sufficient frictional engagement in a highly fibrous material, such as fabric or mesh, where fibers 58 can become entangled or intertwined with the native fibers of the upper pane. This can be particularly advantageous in top grain leather where the fibrous part of the hide has been separated from the remaining solid, surface portion of the hide.

In an example, panels 38 and 40 have different color and texture. For example, panel 38 can comprise leather and panel 40 can comprise wool fabric. In such an example, backing panel 56 can comprise a felt having the color of heel panel 40. As such, the higher density of needle zone 64A is positioned to engage heel panel 40 so that felting 12A matches the color of heel panel 40 to minimize the perceptibility of a visual edge. Specifically, needle zone 64A can overlap with both toe panel 38 and heel panel 40, while needle zone 64B can overlap only toe panel 38.

Felting tool 60 is described as having two different felting density zones. However, a greater number of felting zones can be used to provide a higher degree of felting gradation between heel panel 40 and toe panel 38. In other examples, felting tool 60 can be provided with a single zone of needles that are arranged with a varying density over a gradient. Although the felting of the present disclosure is described as being carried out using felting tool 60, such description is provided for illustrative purposes only. In other examples, other felting tools, systems and machines may be utilized to provide felting 12A and felting 12B.

Felting tool 60 is advanced into toe panel 38 and heel panel 40 before sole structure 16 is attached to upper 14. Thus, upper 14, specifically toe panel 38 and heel panel 40, can be laid flat to engage felting tool 60. Needles of needle zones 64A and 64B can be barbed to engage fibers 58. Felting tool 60 can be advanced toward panels 38 and 40 so that needles of needle zones 64A and 64B pass through toe panel 38 and heel panel 40, and the barbs drag fibers 58 through to the exterior E of upper 14. In the example shown, felting tool produces two zones of felting that, when offset from edges 50 and 52, produce three zones of felting sandwiched between two un-felted zones.

In an example, zone Z1 comprises a heel region where upper 14 has the appearance of unfelted material of heel panel 40. Thus, in the example of FIGS. 3 and 4, heel panel 40 comprises unfelted wool fabric. Zone Z2 comprises a heel region where upper 14 has the appearance of felted material of heel panel 40. Thus, in the example of FIGS. 3 and 4, heel panel 40 comprises felted wool fabric. Zone Z2 is felted according to the density of first needle zone 64A of felting tool 60.

Zone Z3 comprises a toe region where upper 14 has the appearance of felted material of toe panel 38. Thus, in the example of FIGS. 3 and 4, toe panel 38 comprises a first region of felted leather. Zone Z3 is felted according to the density of first needle zone 64A of felting tool 60. Zone Z4 comprises a toe region where upper 14 has the appearance of felted material of toe panel 38. Thus, in the example of FIGS. 3 and 4, toe panel 38 comprises a second region of felted leather. Zone Z4 is felted according to the density of second needle zone 64B of felting tool 60. Thus, zone Z4 has a lower density of felting fibers 58 than zone Z3. Zone Z5 comprises a toe region where upper 14 has the appearance of unfelted material of toe panel 38. Thus, in the example of FIGS. 3 and 4, toe panel 38 comprises unfelted leather.

Felting 12A is thus configured to have a higher density of fibers 58 drawn through heel panel 40 as compared to the density of fibers 58 drawn through toe panel 38. Thus, in zone Z2 at heel panel 40, fibers 58 provide a high level of mechanical interlocking, while also being visually difficult to perceive at heel panel 40 regardless of the density of fibers 58 due to the color match. As felting 12A extends from heel panel 40 into toe panel 38 at posterior edge 50, felting can continue at the same density as zone Z2 in zone Z3 to visually, from a color standpoint, resemble an extension of heel panel 40, but at a reduced density. Needle zone 64A does not provide one hundred percent density of felting in toe panel 38. In one example, needle zone 64A produces approximately 66% felting density. Further away from posterior edge 50 in zone Z4, further in the anterior direction on toe panel 38, the density of fibers 58 can trail off to become less dense than in zone Z3 to visually, from a color standpoint, resemble heel panel 40 becoming thinner and disintegrating, and ultimately terminating at edge 65. In one example needle zone 64B produces approximately 33% felting density. Thus, in the example of FIGS. 3 and 4, felting 12A simulates a linear transition resembling a gradual blending of panels 38 and 40. In other examples, felting 12A does not follow a linear transition in the anterior-posterior direction. For example, fibers 58 of backing panel 56 can dissipate on a logarithmic scale.

As mentioned above, the materials, texture and color for toe panel 38 and heel panel 40 can vary so as to provide different aesthetic effects. For example, in one example, panels 38 and 40 can have the same color and felting 12A can provide a transition in texture. In such an example, heel panel 40 can be made from the same material as backing panel 56 such that felting 12A extends heel panel 40 into toe panel 38 of a different material. Various combinations of color, texture and material can be selected bearing in mind the desired aesthetic effect and the resulting mechanical, frictional interlocking of the felting fibers with the different types of material for each pane.

Figure 5:
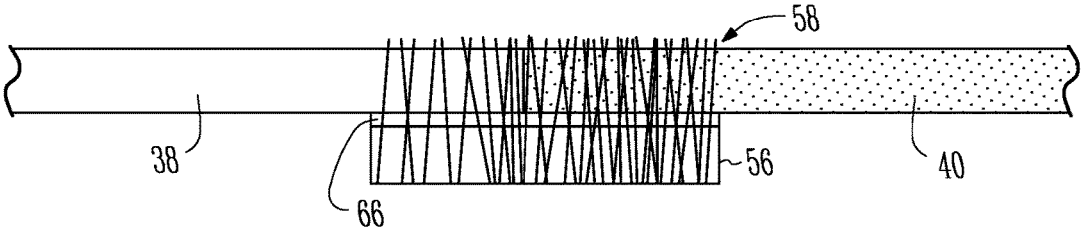
FIG. 5 is a cross-sectional view of the felting stitch of FIG. 3 showing an embodiment having an adhesive layer positioned between the backing panel and the felting stitch in the first panel and the second panel.

FIG. 5 is a cross-sectional view of felting 12A of FIG. 3 showing an embodiment having adhesive layer 66 positioned between backing panel 56 and toe panel 38 and heel panel 40. Felting 12A of FIG. 5 is configured similarly as that of FIG. 4 except adhesive layer 66 is provided to form an initial bond between backing panel 56 and toe panel 38 and heel panel 40. Adhesive layer 66 can be used in addition to or alternatively to stitch 54. Adhesive layer 66 can facilitate the felting process by, for example, facilitating the pushing of fibers 58 through panels 38 and 40 in a uniform manner. That is, adhesive layer 66 can prevent wrinkling or bunching of panels 38, 40 and 56 to facilitate proper orientation, alignment and insertion of needles 64 through the panels. Any suitable adhesive may be used. For example, hot melt adhesive such as ethylene-vinyl acetate (EVA) copolymers may be used. In other examples, solvent based adhesives or polymer dispersion adhesives may be used. In one example, adhesive layer 66 can be applied after stitch 54 is formed, followed by placement of backing panel 56 over the adhesive layer. In various examples, placement and insertion of fibers 58 can occur after the adhesive layer is set, e.g. dried or hardened. In other examples, an adhesive layer can be applied over backing panel 56 and the inside of panels 38 and 40 within interior I of upper 14 after the felting process to immobilize the backing layer.

Figure 6:
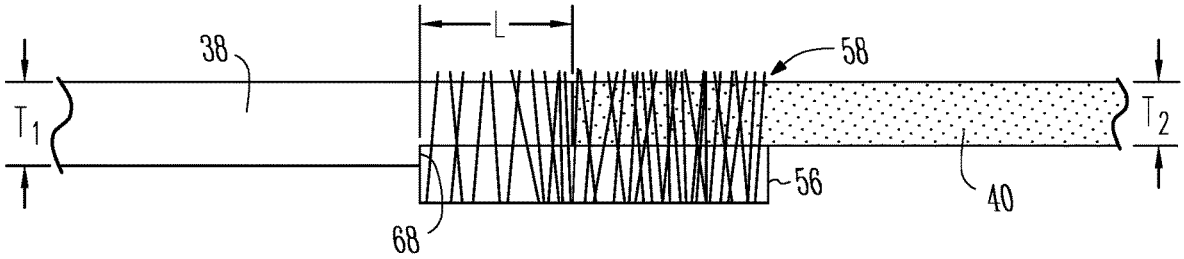
FIG. 6 is a cross-sectional view of the felting stitch of FIG. 3 showing an embodiment in which the first panel includes skiving to reduce its thickness at the felting stitch.

FIG. 6 is a cross-sectional view of felting 12A of FIG. 3 showing an embodiment in which toe panel 38 includes skiving 68 to reduce its thickness at felting 12A. Felting 12A of FIG. 6 is configured similarly as that of FIG. 4 except skiving 68 is provided on toe panel 38 to facilitate fibers of backing panel 56 passing through toe panel 38. Skiving 68 can extend along length L to reduce initial thickness T1 of toe panel 38 along backing panel 56. Skiving length L can also selected to extend beyond the length of backing panel 56. For example, skiving 68 can extend further to the left in FIG. 6. Skiving 68 can reduce initial thickness T1 to reduced thickness T2 along at least the length toe panel 38 engages backing panel 56. Thickness T2 can be selected to match the thickness of second panel 40. In another example, thickness T2 can be selected based on the felting process, such as the length of felting needles or the thickness of backing panel 56. For example, the thickness of backing panel 56 can correspond approximately to the length of fibers 58 available for passing through toe panel 38. Thus, thickness T2 can be selected to be less than the length of fibers 58 or the thickness of backing panel 56. Stitch 54 and adhesive layer 66 can be used in combination with skiving 68. Skiving 68 can be provided on toe panel 38 before the felting process occurs, but after toe panel 38 is cut to the shape desired or needed for the fabrication of upper 14.

Figure 7:
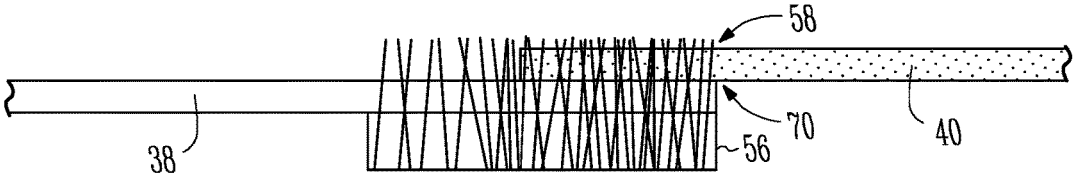
FIG. 7 is a cross-sectional view of the felting stitch of FIG. 3 showing an embodiment where the first and second panels overlap with each other.

FIG. 7 is a cross-sectional view of felting 12A of FIG. 3 showing an embodiment where toe panel 38 and heel panel 40 overlap with each other along overlap 70. Felting 12A of FIG. 7 is configured similarly as that of FIG. 4 except overlap 70 is provided between toe panel 38 and heel panel 40 to facilitate fibers of backing panel 56 passing there-through and to facilitate construction of felting 12A. In some examples, particularly those where one or both of toe panel 38 and heel panel 40 are thin relative to, for example, the length of fibers 58 and needles 64, toe panel 38 and heel panel 40 can be overlapped to facilitate fabrication of felting 12. For example, it can be easier to provide stitch 54 and adhesive layer 66, while panels 38 and 40 are overlapped rather than abutted. Overlap 70 can extend partially across felting 12A as shown in FIG. 7 in order to allow the aesthetic effects, e.g. transitioning or blending of color and texture, of felting 58 to occur to provide mechanical, frictional joining. In other examples, overlap 70 can extend the entire length of felting 12A. Overlap 70 can also provide an additional texture transition by allowing the length of free ends of fibers 58 extending through panels 38 and 40 to vary. As shown in FIG. 7, fibers 58 extend just beyond heel panel 40, but extend beyond toe panel 38 that same amount plus the thickness of heel panel 40. As such, regions of varying fiber lengths can be produced with overlap 70.

FIG. 8 is a perspective view of article of footwear 10 having toe panel 38 and heel panel 40 of upper 14 joined by felting 72 having a variety of aesthetic features, such as bleed pattern 74. Footwear 10 includes the same elements as that of FIG. 1 and repeated discussion is not provided here. Felting 72 can be produced in a similar fashion as felting 12A, i.e. by passing fibers 58 of backing panel 56 through toe panel 38 and heel panel 40. FIG. 8, however, illustrates that felting 72 can provide other aesthetic qualities than the transition shown in FIG. 1. In particular, felting 72 includes bleed pattern 74 at the juncture with toe panel 38. Bleed pattern 74 can comprise an irregular pattern that replicates a tattered edge or a liquid flowing across a surface. Thus, bleed pattern can have a plurality of peaks 76 and valleys 78. FIG. 8 also illustrates that felting 72 can produce stark contrast between panels and abrupt changes in color and texture. For example, heel panel 40 can be joined at felting 72 by straight, abrupt edge 80. Additionally, felting 72 can be made of a felting material that is different than the materials of toe panel 38 and heel panel 40, but that provides adequate mechanical, frictional interlocking with those material. For example, felting 72 can be felt, while toe panel 38 comprises leather and heel panel 40 comprises a polymeric material.

VARIOUS NOTES & EXAMPLES

Example 1 can include or use subject matter such as an article of footwear comprising a sole structure, and an upper connected to the sole structure to form an enclosure to at least partially receive a foot, the upper comprising a first panel and a second panel that at least partially form the upper, a backing panel located within the enclosure along surfaces of the first and second panels, and fibers extending from the backing panel and mechanically embedded in the first and second panels so that at least some of the fibers are partially disposed outside the enclosure.

Example 2 can include, or can optionally be combined with the subject matter of Example 1, to optionally include a backing panel comprising felt.

Example 3 can include, or can optionally be combined with the subject matter of one or any combination of Examples 1 or 2 to optionally include first and second panels that are mechanically joined by a felting joint using the backing panel.

Example 4 can include, or can optionally be combined with the subject matter of one or any combination of Examples 1-3 to optionally include fibers including fibers of the backing panel that extend through the first panel and fibers that extend through the second panel.

Example 5 can include, or can optionally be combined with the subject matter of one or any combination of Examples 1-4 to optionally include a volume of the fibers of the backing panel disproportionately extending through the first panel relative to the second panel.

Example 6 can include, or can optionally be combined with the subject matter of one or any combination of Examples 1-5 to optionally include a color of the backing panel that is the same as a color of one of the first or second panels.

Example 7 can include, or can optionally be combined with the subject matter of one or any combination of Examples 1-6 to optionally include fibers of the backing panel that extend through the first and second panels to simulate a bleeding of the first panel into the second panel.

Example 8 can include, or can optionally be combined with the subject matter of one or any combination of Examples 1-7 to optionally include fibers of the backing panel that extend through the one of the first or second panels more than the other of the first and second panels.

Example 9 can include, or can optionally be combined with the subject matter of one or any combination of Examples 1-8 to optionally include a stitch joining the first panel and the second panel.

Example 10 can include, or can optionally be combined with the subject matter of one or any combination of Examples 1-9 to optionally include an adhesive layer disposed between the backing panel and the first and second panels.

Example 11 can include, or can optionally be combined with the subject matter of one or any combination of Examples 1-10 to optionally include a lining layer extending over the backing panel, the first panel, the second panel on an interior of the article of footwear.

Example 12 can include, or can optionally be combined with the subject matter of one or any combination of Examples 1-11 to optionally include first and second panels that are abutted along edges adjacent the backing panel.

Example 13 can include, or can optionally be combined with the subject matter of one or any combination of Examples 1-11 to optionally include first and second panels that overlap along edges adjacent the backing panel.

Example 14 can include, or can optionally be combined with the subject matter of one or any combination of Examples 1-13 to optionally include one of the first and second panels being thinned along an interface with the backing panel.

Example 15 can include, or can optionally be combined with the subject matter of one or any combination of Examples 1-14 to optionally include first and second panels that are comprised of different materials.

Example 16 can include, or can optionally be combined with the subject matter of one or any combination of Examples 1-15 to optionally include the first panel being comprised of a fibrous material and the second panel being comprised of a solid material.

Example 17 can include, or can optionally be combined with the subject matter of one or any combination of Examples 1-16 to optionally include fibers of the backing panel extending through the solid material in a greater density than fibers extending through the fibrous material.

Example 18 can include, or can optionally be combined with the subject matter of one or any combination of Examples 1-17 to optionally include the first panel being comprised of wool and the second panel being comprised of leather.

Example 19 can include or use subject matter such as an upper for an article of footwear comprising a first panel of a first material, a second panel of a second material; and a backing panel having fibers that extend through the first and second materials to mechanically join to the first and second panels.

Example 20 can include, or can optionally be combined with the subject matter of Example 19, to optionally include fibers of the backing panel extending into the first and second panels disproportionately.

Example 21 can include, or can optionally be combined with the subject matter of one or any combination of Examples 19 or 20 to optionally include a color of the backing panel matching a color of only one of the first panel and the second panel to simulate a fading of the first panel into the second panel.

Example 22 can include, or can optionally be combined with the subject matter of one or any combination of Examples 19-21 to optionally include a stitch joining the first and second panels, an adhesive joining the backing panel to the first and second panels, and a lining layer extending along the first and second panels and the backing panel.

Example 23 can include, or can optionally be combined with the subject matter of one or any combination of Examples 19-22 to optionally include first and second panels that are abutted at edges of each panel and at least some of the fibers of the backing panel extend across the abutted edges.

Example 24 can include, or can optionally be combined with the subject matter of one or any combination of Examples 19-23 to optionally include one of the first panel and the second panel being skived along the backing panel.

Example 25 can include or use subject matter such as a felting seam for an article of footwear comprising a first panel having a first edge, a second panel having a second edge adjacent the first edge at an interface, a backing panel disposed along the interface along one side of the first panel and the second panel, and a plurality of fibers of the backing panel extending through the first panel and the second panel, wherein a density of the fibers is greater in the first panel than in the second panel.

Example 26 can include, or can optionally be combined with the subject matter of Example 25, to optionally include a stitch joining the first and second panels, and a lining layer extending along the first and second panels and the backing panel.

Example 27 can include, or can optionally be combined with the subject matter of one or any combination of Examples 25 or 26 to optionally include an adhesive joining the backing panel to the first and second panels.

Example 28 can include, or can optionally be combined with the subject matter of one or any combination of Examples 25-27 to optionally include one of the first panel and the second panel being skived along the interface.

Each of these non-limiting examples can stand on its own, or can be combined in various permutations or combinations with one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of"at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. An article of footwear comprising:

a sole structure; and an upper connected to the sole structure to form an enclosure configured to at least partially receive a foot, the upper comprising:

a first panel and a second panel that at least partially form the upper, the first panel and the second panel placed adjacent at a joint such that the first panel and the second panel at least partially extend sequentially along a longitudinal axis;

a backing panel located within the enclosure and extending in the longitudinal direction along surfaces of the first and second panels; and fibers extending from the backing panel, the fibers being mechanically embedded in the first and second panels so that at least some of the fibers are partially disposed outside the enclosure along a segment of the longitudinal axis proximate the joint;

wherein at least a portion of the first panel and a portion of the second panel are exposed along surfaces opposite the backing panel and do not include fibers of the backing panel extending therethrough;

wherein the upper comprises a plurality of zones extending sequentially along the longitudinal axis, the plurality of zones comprising:

a first zone comprising a first portion of the first panel without fibers from the backing panel extending therethrough;

a second zone comprising a second portion of the first panel with fibers from the backing panel extending therethrough;

a third zone comprising a first portion of the second panel with fibers from the backing panel extending therethrough;

a fourth zone comprising a second portion of the second panel without fibers from the backing panel extending therethrough; and a fifth zone between the second zone and the third zone comprising a third portion of the first panel with fibers from the backing panel extending therethrough;

wherein the second zone, the fifth zone and the third zone have decreasing densities of fibers from the backing panel extending therethrough.

2. The article of footwear of claim 1, wherein the backing panel comprises felt.

3. The article of footwear of claim 2, wherein the first panel and the second panel are mechanically joined by a felting joint using the backing panel.

4. The article of footwear of claim 1, wherein the fibers include fibers of the backing panel that extend through the first panel and fibers that extend through the second panel.

5. The article of footwear of claim 4, wherein a volume of the fibers of the backing panel disproportionately extend through the first panel relative to the second panel.

6. The article of footwear of claim 5, wherein a color of the backing panel is the same as a color of one of the first or second panels.

7. The article of footwear of claim 6, wherein the fibers of the backing panel extend through the first and second panels to simulate a bleeding of the first panel into the second panel in the longitudinal direction.

8. The article of footwear of claim 1, wherein the joint extends along a straight-line transverse to the longitudinal axis.

9. The article of footwear of claim 1, further comprising a stitch joining the first panel and the second panel.

10. The article of footwear of claim 1, further comprising an adhesive layer disposed between the backing panel and the first and second panels.

11. The article of footwear of claim 1, further comprising a lining layer extending over the backing panel, the first panel, the second panel on an interior of the article of footwear.

12. The article of footwear of claim 1, wherein the first and second panels are longitudinally abutted along edges adjacent the backing panel.

13. The article of footwear of claim 1, wherein the first and second panels longitudinally overlap along edges adjacent the backing panel.

14. The article of footwear of claim 1, wherein one of the first and second panels is thinned along an interface with the backing panel.

15. The article of footwear of claim 1, wherein the first panel and the second panel are comprised of different materials.

16. The article of footwear of claim 15, wherein the first panel is comprised of a fibrous material and the second panel is comprised of a solid material.

17. The article of footwear of claim 16, wherein fibers of the backing panel extend through the solid material in a greater density than fibers extending through the fibrous material and portions of the first panel do not have any fibers extending through.

18. The article of footwear of claim 15, wherein the first panel is comprised of wool and the second panel is comprised of leather.

19. The article of footwear of claim 1; wherein the portions of the first and second panels that are exposed along surfaces opposite the backing panel are located on an exterior of the upper.

20. The article of footwear of claim 1, wherein the first and fourth portion of the first panel and the second portion of the second panel are not positioned against the backing panel within the enclosure.

21. The article of footwear of claim 1, wherein:

the backing panel extends in the longitudinal direction along first surfaces of the first and second panels;

fibers of the backing panel extend through second surfaces of the first and second panels opposite the first surfaces; and wherein a volume of the fibers of the backing panel disproportionately extend through the first panel relative to the second panel at the second surfaces.

22. An article of footwear comprising:

a sole structure; and an upper connected to the sole structure to form an enclosure configured to at least partially receive a foot, the upper comprising:

a first panel and a second panel that at least partially form the upper, the first panel and the second panel placed adjacent at a joint such that the first panel and the second panel at least partially extend sequentially along a longitudinal axis;

a backing panel located within the enclosure and extending in the longitudinal direction along first surfaces of the first and second panels; and fibers extending from the backing panel, the fibers being mechanically embedded in the first and second panels so that at least some of the fibers are partially disposed outside the enclosure along a segment of the longitudinal axis proximate the joint along second surfaces of the first and second panels;

wherein a volume of the fibers of the backing panel disproportionately extend through the first panel relative to the second panel at the second surfaces;

wherein the fibers of the backing panel extend through the first and second panels to simulate a bleeding of the first panel into the second panel in the longitudinal direction, wherein the bleeding comprises a patterning of the fibers of the backing panel that extend through the first and second panels of the upper to form an irregular bleed pattern of peaks and valleys having varying lengths in the longitudinal direction.

* * * * *